US006869461B2

(12) United States Patent
Hattori et al.

(10) Patent No.: US 6,869,461 B2
(45) Date of Patent: Mar. 22, 2005

(54) FINE POWDER OF METALLIC COPPER AND PROCESS FOR PRODUCING THE SAME

(75) Inventors: Yasumasa Hattori, Ehime (JP); Nobuyuki Kii, Ehime (JP); Atsushi Kanesaka, Ehime (JP)

(73) Assignee: Sumitomo Metal Mining Co., Ltd., Tokyo (JP)

( * ) Notice: Subject to any disclaimer, the term of this patent is extended or adjusted under 35 U.S.C. 154(b) by 0 days.

(21) Appl. No.: 10/659,749

(22) Filed: Sep. 11, 2003

(65) Prior Publication Data

US 2004/0112477 A1 Jun. 17, 2004

(30) Foreign Application Priority Data

Sep. 11, 2002 (JP) ..... 2002-265851
Aug. 7, 2003 (JP) ..... 2003-288481

(51) Int. Cl.[7] ..... B22F 9/06
(52) U.S. Cl. ..... 75/338
(58) Field of Search ..... 75/338

(56) References Cited

U.S. PATENT DOCUMENTS 3,565,604 A * 2/1971 Akimoto et al. ..... 75/338

FOREIGN PATENT DOCUMENTS

| | | |
|---|---|---|
| JP | 63-31522 | 6/1988 |
| JP | 2-57623 | 2/1990 |
| JP | 2002-20809 | 1/2002 |
| WO | WO 97/16275 | 5/1997 |

* cited by examiner

*Primary Examiner*—Ngoclan T. Mai
(74) *Attorney, Agent, or Firm*—Westerman, Hattori, Daniels & Adrian, LLP

(57) ABSTRACT

A fine powder of metallic copper, suitable as a material for electroconductive pastes, and having a BET diameter of 3 μm or less, large crystallite size, high dispersibility and particles of high sphericity and a process for producing the same. More specifically, a fine powder of metallic copper having a BET diameter of 3 μm or less, particles of high sphericity and crystallites of 0.1 to 10 μm in size, and more preferably containing oxygen at 0.3% by weight or less. Moreover, the fine powder of metallic copper can be produced stably and efficiently by blowing an ammonia-containing gas onto molten copper kept at 1120° C. More specifically, it can be produced more stably and efficiently by blowing ammonia at 0.015 L/minute or more per unit area ($cm^2$) of the molten copper.

2 Claims, 1 Drawing Sheet

FINE POWDER OF METALLIC COPPER AND PROCESS FOR PRODUCING THE SAME

BACKGROUND OF THE INVENTION

1. Field of the Invention

The present invention relates to a fine powder of metallic copper and process for producing the same, more particularly a fine powder of metallic copper, suitable as a material for electroconductive pastes, and having a BET diameter of 3 μm or less, large crystallite size, high dispersibility and particles of high sphericity, and a process for producing the same.

2. Description of the Prior Art

An electroconductive metallic powder for electroconductive pastes to be used for forming circuits or multilayer capacitors is required to be low in impurity content, and have particles uniform in shape and size, and well dispersed while being little agglomerated, among others. The other requirements include high dispersibility in the paste and high crystallinity to prevent uneven sintering.

More specifically, the metallic powders have been particularly demanded recently to be composed of particles having:

(1) a size determined by the BET method (hereinafter sometimes referred to as BET diameter) of 3 μm or less,
(2) highly spherical shape and high dispersibility, and
(3) a sufficiently large crystallite size to prevent reoxidation.

One of the well-known processes for producing fine metallic powders is gas spraying, in which molten metal is sprayed from one or more nozzles into an inert gas, e.g., argon, to be quenched therein. However, it is difficult for such a process to produce particles of high sphericity and uniform size, 3 μm or less. When particles of high sphericity having a size of 3 μm or less are to be produced by this process, it is necessary to classify the spherical particles produced, which decreases the yield and pushes up the cost. Another problem involved in this process is observed when spherical particles of base metal, e.g., copper, are to be produced, because they are oxidized while the molten metal is sprayed to only give a product of high oxygen content.

Another known process for producing fine metallic particles is spray pyrolysis, in which a solution or suspension of one or more types of metallic compounds is sprayed into fine droplets and thermally treats them to decompose the metallic compound at a temperature level higher than its decomposition temperature, preferably close to or higher than its melting point, in order to separate out the powdery metal or alloy (see e.g., JP-B-63-31522).

This process can give highly spherical particles of metal or alloy, high in crystallinity, or single-crystalline and high both in density and dispersibility. It has several advantages. For example, it needs no solid/liquid separation, unlike the wet reduction process to simplify the production process, and also needs no additive or solvent which may affect the product purity, to give the high-purity powder free of impurities. Moreover, it can easily control particle size, and also easily controls the product composition, because composition of the product particles basically coincides with that of the metallic compound(s) in the starting solution.

However, this process involves a problem: it thermally decomposes droplets containing the starting metallic compound(s), which invariably decomposes the solvent, e.g., water, or alcohol, acetone, ether or another organic compound, to increase the energy cost for the pyrolysis or the like.

This process evaporates the solvent under heating and then thermally decomposes the particles of the condensed metallic compound(s), which needs a large quantity of energy for evaporating the solvent. Moreover, the product powder may have a broader particle size distribution, when the sprayed droplets coalesce with each other or are broken up. Prevention of these problems needs fine control of the reaction conditions, e.g., spraying speed, concentration of the droplets in the carrier gas and residence time in the reactor, which is very difficult to realize. Moreover, this process, when applied to production of powder of base metal, e.g., copper, needs a reducing or weakly reducing atmosphere under which the thermal decomposition is strictly controlled, which is difficult. Still more, when water is used as the solvent, the oxidative gas generated by decomposition of water oxidizes copper or the like, with the result that the powder of high crystallinity can be no longer obtained.

A vapor-phase chemical reaction process is also well-known for producing metallic particles. For example, there is a process which reacts cuprous chloride vapor with a reducing gas at 700 to 900° C. to produce the fine copper particles (see e.g., JP-A-2-57623).

In this process, cuprous chloride vapor, evaporated at 700 to 900° C., is reacted with hydrogen to produce fine copper particles having large crystallite size and resistant to oxidation.

In this process, however, production rate of the fine copper particles is determined by the vapor pressure of cuprous chloride at 700 to 900° C., and hence is limited. Therefore, the process has a disadvantage of being difficult to have a high production rate and hence high production capacity. Moreover, the particles separated from the vapor phase tend to agglomerate with each other and are difficult to control particle size.

One of the processes which have been recently proposed is reduction based on solid/vapor reaction, in which powdered metallic compound, e.g., tungsten oxide, is brought into contact with a gaseous reducing agent (see e.g., JP-A-11-503205). More specifically, the powdered metallic compound to be reduced is sprayed, together with the gaseous reducing medium and carrier gas, into a temperature-controllable reaction chamber, where the powdered metallic compound is passed through the reaction zone in a given track for 0.4 to 60 seconds on the average, to reduce the compound to a conversion of 90% or higher.

This process, initiating the reaction itself by bringing the solid starting compound into contact with the reducing gas, involves a problem of being difficult to completely reduce the starting compound into the metallic state in a short time, because it has a smaller reaction area than the vapor-phase process described above. Moreover, it is difficult for this process to completely reduce the starting compound into the metallic state, even when the reaction time is extended by use of a cyclone as the reaction vessel to extend the particle tracks or by breaking up the solid starting compound to reduce its size and thereby to increase its reaction area. Therefore, this process is considered to be difficult to produce high-crystallinity, particles of high sphericity and uniform size, suitable for electronic devices.

More recently, another process is proposed, in which one or more types of thermally decomposable metallic compound powders, e.g., metallic hydroxide, metallic nitrate or organometallic compound, are charged into a reactor together with a carrier gas, dispersed in the vapor phase at a concentration of 10 g/L or less, and heated at the decomposition temperature or higher but (Tm-200)° C. or lower (Tm: melting point of the metallic compound) (see e.g., JP-A-2002-20809).

This process keeps the reaction atmosphere reductive, irrespective of carrier gas, by use of an organometallic compound as the starting material, although the metal is base in itself, to produce the metallic particles.

However, it is essential for this process to use starting particles of uniform size, because size of the product metallic particles is in proportion to that of the starting particles. The starting particles, therefore, should be crushed, beaten or classified beforehand by a crusher or classifier. Moreover, an organometallic compound, when used, should be completely combusted, which additionally increases the energy cost. Still more, this process tends to form an oxide, nitride or carbide.

As discussed above, fine metallic powders suitable for electroconductive pastes have been strongly in demand, as demands for electroconductive metallic powders are rapidly growing for circuits and laminate condensers. However, the conventional fine base metal powders, in particular copper, cannot satisfy these requirements simultaneously. Therefore, there are strong demands for fine powders of metallic copper, having a BET diameter of 3 μm or less, large crystallite size, high dispersibility and particles of high sphericity.

SUMMARY OF THE INVENTION

The present invention is achieved in consideration of the situations and problems in the conventional techniques. It is an object of the present invention to provide a fine powder of metallic copper, suitable as a material for electroconductive pastes, and having a BET diameter of 3 μm or less, large crystallite size, high dispersibility and particles of high sphericity. It is another object of the present invention to provide a process for producing the same.

The inventors of the present invention have created, after having extensively studied to solve the above problems, a fine powder of metallic copper having a BET diameter of 3 μm or less, particles of high sphericity and crystallites of specific size to find that it is much better as a powder for electroconductive pastes than the conventional ones, and that the fine powder of metallic copper having excellent characteristics can be produced by blowing ammonia or an ammonia-containing gas onto molten copper kept at a specific temperature or higher, achieving the present invention.

The first aspect of the present invention provides a fine powder of metallic copper having a BET diameter of 3 μm or less, particles of high sphericity and crystallites having a size of 0.1 to 10 μm.

The second aspect of the present invention provides the fine powder of metallic copper of the first aspect, wherein oxygen is contained at 0.3% by weight or less.

The third aspect of the present invention provides the fine powder of metallic copper of the first or second aspect which is to be used as a material for electroconductive pastes.

The fourth aspect of the present invention provides a process for producing the fine powder of metallic copper of one of the first to third aspects by blowing an ammonia-containing gas onto molten copper, wherein the molten copper is kept at 1120° C. or higher.

The fifth aspect of the present invention provides the process of the fourth aspect for producing the fine powder of metallic copper, wherein the ammonia-containing gas is ammonia gas itself, or a mixture of ammonia gas and a non-oxidative or inert gas.

The sixth aspect of the present invention provides the process of the fifth aspect for producing the fine powder of metallic copper, wherein the ammonia-containing gas is blew at 0.015 L/minute or more per unit area ($cm^2$) of the molten copper.

The fine powder of metallic copper of the present invention has a BET diameter of 3 μm or less, large crystallite size, high dispersibility and particles of high sphericity. It satisfies all of the characteristics now required for an electroconductive metallic powder for electroconductive pastes for forming circuits or multilayer capacitors, and hence is very useful as a material for electroconductive pastes.

The electroconductive metallic powder containing oxygen at 0.3% by weight or less while satisfying all of the above characteristics, which is one of the embodiments of the fine powder of metallic copper of the present invention, is suitable for some devices, e.g., multilayer capacitors, which are very sensitive to oxide formed therein.

The process of the present invention for producing the fine powder of metallic copper, blowing an ammonia-containing gas onto molten copper kept at 1120° C. or higher, is highly reliable and practical, capable of efficiently producing the fine powder of metallic copper having the excellent characteristics, and hence of high industrial value. Its usefulness should be further enhanced, when the ammonia-containing gas is blew at 0.015 L/minute or more per unit area ($cm^2$) of the molten copper, because the fine powder of metallic copper of the present invention can be produced stably and efficiently under the above condition.

DETAILED DESCRIPTION OF THE INENTION

Figure 1:
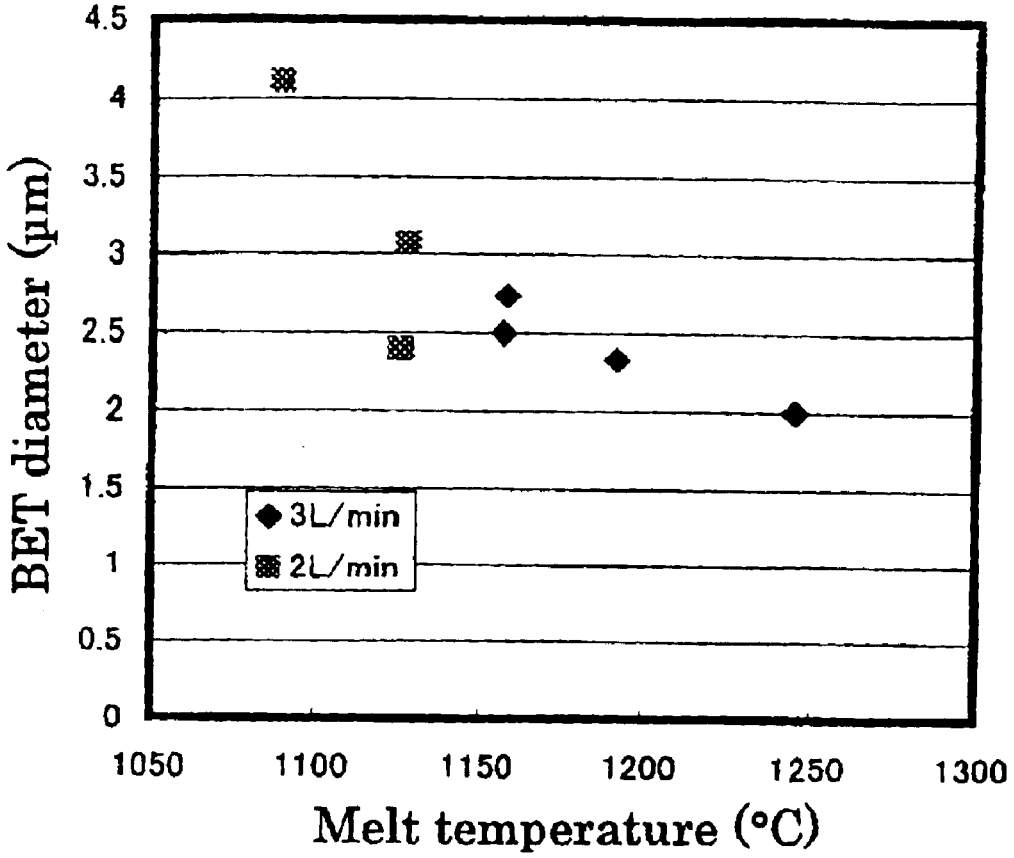
FIG. 1 shows the relationship between BET diameter of the fine metallic copper particles and melt temperature (temperature of molten copper), where flow rate of ammonia gas blew onto the molten copper surface (initial surface area: 50 $cm^2$) is set at 2 or 3 L/minute.

The fine powder of metallic copper of the present invention and process for producing the same are described in detail.

1. Fine Powder of Metallic Copper

The fine powder of metallic copper of the present invention has a BET diameter of 3 μm or less, preferably 2 μm or less, more preferably 1 μm or less. It is composed of the particles of high sphericity and has crystallites of 0.1 to 10 μm in size, preferably 0.1 to 5 μm. The crystallites are preferably single-crystalline. These characteristics coincide with the standards which an electroconductive metallic powder for electroconductive pastes to be used for forming circuits or multilayer capacitors is recently required to have, as discussed above.

One of the preferred embodiments of the present invention is the fine powder of metallic copper containing oxygen at 0.3% by weight or less, preferably 0.2% or less, more preferably 0.15% or less, while satisfying all of the above characteristics. The oxygen content of 0.3% by weight or less is a characteristic which makes the fine powder of metallic copper suitable for some devices, e.g., multilayer capacitors, which are very sensitive to oxide formed therein.

The fine powder of metallic copper of the present invention has much better characteristics as a material for electroconductive pastes than the conventional ones. In particular, it satisfies all of the characteristics which have been considered to be difficult to realize in the related industry, and hence is very useful as a material for electroconductive pastes.

2. Process for Producing the Fine Powder of Metallic Copper

The fine powder of metallic copper of the present invention can be produced by blowing an ammonia-containing gas onto molten copper. This process is characterized by keeping the molten copper at 1120° C. or higher, preferably 1200 to 1400° C., more preferably 1300 to 1400° C. This process is described in detail below.

The process of the present invention can produce the fine powder of metallic copper at a rate much exceeding the one associated with the maximum evaporation rate estimated from the saturation vapor pressure of the molten metal (the maximum evaporation rate is hereinafter sometimes referred to as the theoretical maximum evaporation rate). This is considered to result from thermal decomposition of ammonia when it is blew onto the molten copper to generate active, atomic hydrogen or nitrogen which reacts with copper to realize a very high evaporation rate. The resulting compound, which is non-equilibrium, will be decomposed as soon as it is evaporated, to form the pure copper particles.

Therefore, it is considered, based on the above reaction mechanism, that controlling the parameters which determine rate and extent of the reaction between the active gas and copper is essential, in order to produce the fine powder of metallic copper of the present invention. The important parameters to be controlled include rate at which ammonia is supplied onto the molten copper surface and melt surface area, in addition to temperature at which the copper is molten.

Therefore, the fine powder of metallic copper of the present invention, having a BET diameter of 3 $\mu$m or less, particles of high sphericity and crystallites having a size of 0.1 to 10 $\mu$m, can be produced by controlling adequately these parameters within the industrially practical ranges.

The effects of these parameters on the BET diameter are described by referring to the attached drawing. FIG. 1 plots BET diameter of the fine metallic copper particles against melt temperature (temperature of molten copper), where flow rate of ammonia gas blew onto the molten copper surface (initial surface area: 50 $cm^2$) is set at 2 or 3 L/minute. It is found, as shown in FIG. 1, that BET diameter of 3 $\mu$m or less can be realized, when the molten copper is kept at 1120° C. or higher.

Rate at which ammonia gas is supplied onto the unit area of the molten copper is another important parameter to be controlled. This parameter is determined from flow rate of ammonia gas blew onto the molten copper surface, divided by the surface area.

This parameter is not limited. However, it is preferably 0.015 L/minute or more per unit area ($cm^2$) of the molten copper, preferably 0.03 L/minute or more, more preferably 0.04 L/minute or more.

The ammonia-containing gas for the present invention is not limited, so long as it contains ammonia. It is however recommended to be ammonia gas itself, or a mixture of ammonia gas and a non-oxidative or inert gas, because the produced particles of metallic copper should be transferred to the recovery section while being prevented from oxidation.

When the mixed gas is used, the specific production parameters, e.g., ammonia concentration, flow rate and pressure, vary depending on type and dimensions of the production system, strictly speaking. Therefore, it is recommended to determine these parameters beforehand for a specific production system.

The starting material for molten copper may be high-purity copper, electrolytic copper, crude copper or the like. A copper alloy may be used in place of the above. However, it should be carefully selected, because the fine powder product of metallic copper may be contaminated with an alloy component to degrade the product for electroconductive pastes.

EXAMPLES

The present invention is described in more detail by EXAMPLES and COMPARATIVE EXAMPLES, which by no means limit the present invention.

Example 1

An alumina crucible (inner diameter: 50 mm) containing high-purity metallic copper was placed in a vertically oriented quartz tube (inner diameter: 70 mm), purged with nitrogen, heated in a resistance-heating type electric oven to melt the copper, and continuously heated to keep the melt at 1200° C. Next, ammonia gas was blew onto the melt surface at 3 L/minute (or 0.15 L/minute per unit area ($cm^2$) of the copper) from a nozzle provided above the molten copper surface. The resulting fine particles were collected by a filter.

The fine particles were confirmed to be of metallic copper by X-ray diffractometry. They were spherical, having a diameter of 0.3 to 7 $\mu$m, as observed by a scanning electron microscope (SEM). The BET diameter was 2.9 $\mu$m. These fine particles were mostly single-crystalline, the remainder being large single crystals agglomerated with one or more smaller crystals, as found from the SIM image of the FIB-prepared cross-section. It was also found that the particles of 1 $\mu$m or less in size were mostly single-crystalline, the particles of 5 $\mu$m or so in size were partly single-crystalline, and the crystallites were 0.3 to 5 $\mu$m in size. In short, it can be considered that these particles are essentially single-crystalline.

The fine powder product of metallic copper was analyzed for its composition. It was found to be of high-purity copper, containing oxygen and carbon at 0.09 and 0.05% by weight, respectively. It was left in air to observe the temporal changes of oxygen and carbon contents. The results indicate that the powder is stable, because the contents increased slightly to 0.14 and 0.07% by weight in 7 days.

The powder production rate was 10.10 g/second·$m^2$, determined from quantity of the metallic copper left in the crucible, and 0.81 g/second·$m^2$, determined from quantity of the recovered fine powder of the metallic copper, both far exceeding the theoretical maximum evaporation rate of 0.36 g/second·$m^2$.

Example 2

An alumina crucible (inner diameter: 75 mm) containing high-purity metallic copper was placed in a vertically oriented quartz tube (inner diameter: 95 mm), purged with nitrogen, heated in a resistance-heating type electric oven to melt the copper, and continuously heated to keep the melt at 1230° C. Next, ammonia gas was blew onto the melt surface at 9 L/minute (or 0.20 L/minute per unit area ($cm^2$) of the copper) from a nozzle provided above the molten copper surface. The resulting fine powder was collected by a filter.

The fine particles had a diameter of 0.2 to 4 $\mu$m and BET diameter of 1.81 $\mu$m. The particles of 4 $\mu$m or so in size were partly single-crystalline, and the crystallites were 0.3 to 4 $\mu$m in size. In short, it can be considered that these particles are essentially single-crystalline, as is the case with those prepared in EXAMPLE 1.

The fine powder product contained oxygen at 0.2% by weight. It was found that increasing ammonia flow rate decreased size of the spherical, metallic copper particles. It was found that the spherical metallic copper particles smaller than those prepared in EXAMPLE 1 were produced by increasing ammonia flow rate.

The powder production rate was 7.4 g/second·$m^2$, determined from quantity of the metallic copper left in the crucible, and 6.3 g/second·$m^2$, determined from quantity of the recovered fine powder of the metallic copper, both far exceeding the theoretical maximum evaporation rate of 0.36 g/second·$m^2$.

Example 3

The fine powder of metallic copper was prepared in the same manner as in EXAMPLE 2, except that the molten copper (melt) was kept at 1160° C. The resulting fine particles had a diameter of 0.2 to 4 μm and slightly larger BET diameter of 2.1 μm. The particles of 4 μm or so in size were partly single-crystalline, and the crystallites were 0.3 to 4 μm in size. In short, it can be considered that these particles are essentially single-crystalline, as is the case with those prepared in EXAMPLE 1. The fine powder product contained oxygen at 0.2% by weight.

The powder production rate was 3.6 g/second·$m^2$, determined from quantity of the metallic copper left in the crucible, and 3.3 g/second·$m^2$, determined from quantity of the recovered fine powder of the metallic copper, both far exceeding the theoretical maximum evaporation rate of 0.36 g/second·$m^2$.

Example 4

An alumina crucible (inner diameter: 80 mm) containing high-purity metallic copper was placed in a vertically oriented quartz tube (inner diameter: 95 mm), purged with nitrogen, heated in a resistance-heating type electric oven to melt the copper, and continuously heated to keep the melt at 1230° C. Next, ammonia gas was blew onto the melt surface at 3 L/minute (or 0.06 L/minute per unit area ($cm^2$) of the copper) from a nozzle provided above the molten copper surface. The resulting fine powder was collected by a filter.

The fine particles had a diameter of 0.2 to 4 μm and BET diameter of 2.3 μm. The particles of 4 μm or so in size were partly single-crystalline, and the crystallites were 0.3 to 4 μm in size. In short, it can be considered that these particles are essentially single-crystalline, as is the case with those prepared in EXAMPLE 1. The fine powder product contained oxygen at 0.2% by weight.

The powder production rate was 2.7 g/second·$m^2$, determined from quantity of the metallic copper left in the crucible, and 2.5 g/second·$m^2$, determined from quantity of the recovered fine powder of the metallic copper, both far exceeding the theoretical maximum evaporation rate of 0.36 g/second·$m^2$.

Example 5

Three alumina crucibles (inner diameter: 230 by 150 mm) containing high-purity metallic copper was placed in a horizontally oriented quartz tube (inner diameter: 250 mm), purged with nitrogen, heated in a resistance-heating type electric oven to melt the copper, and continuously heated to keep the melt at 1300° C. Next, ammonia gas was blew onto the melt surface at 45 L/minute (or 0.043 L/minute per unit area ($cm^2$) of the copper) from a nozzle provided above the molten copper surface. The resulting fine powder was collected by a filter.

The fine particles had a diameter of 0.1 to 4 μm and BET diameter of 0.9 μm. The crystallites were 0.1 to 4 μm in size. The fine powder product contained oxygen at 0.24% by weight.

Example 6

The fine powder of metallic copper was prepared in the same manner as in EXAMPLE 5, except that ammonia gas was blew onto the molten copper surface at 30 L/minute (or 0.029 L/minute per unit area ($cm^2$) of the copper) from a nozzle provided above the molten copper surface. The resulting fine particles had a diameter of 0.1 to 5 μm and BET diameter of 1.2 μm. The crystallites were 0.1 to 5 μm in size. The fine powder product contained oxygen at 0.3% by weight.

The powder production rate was 3.4 g/second $m^2$, determined from quantity of the metallic copper left in the crucible, and 1.61 g/second·$m^2$, determined from quantity of the recovered fine powder of the metallic copper.

Example 7

The fine powder of metallic copper was prepared in the same manner as in EXAMPLE 5, except that ammonia gas was blew onto the molten copper surface at 16 L/minute (or 0.015 L/minute per unit area ($cm^2$) of the copper) from a nozzle provided above the molten copper surface. The resulting fine particles had a diameter of 0.1 to 4 μm and BET diameter of 1.1 μm. The crystallites were 0.1 to 4 μm in size. The fine powder product contained oxygen at 0.3% by weight.

The powder production rate was 2.0 g/second·$m^2$, determined from quantity of the metallic copper left in the crucible, and 1.0 g/second·$m^2$, determined from quantity of the recovered fine powder of the metallic copper.

Comparative Example 1

The fine powder of metallic copper was prepared in the same manner as in EXAMPLE 2, except that the molten copper (melt) was kept at 1100° C. The resulting fine particles had a diameter of 0.3 to 7 μm and BET diameter of 4.1 μm. The particles of 4 μm or so in size were partly single-crystalline, and the crystallites were 0.3 to 7 μm in size. The fine powder product contained oxygen at 0.15% by weight.

The powder production rate was 5.4 g/second·$m^2$, determined from quantity of the metallic copper left in the crucible, and 4.6 g/second·$m^2$, determined from quantity of the recovered fine powder of the metallic copper.

Comparative Example 2

The fine powder of metallic copper was prepared in the same manner as in EXAMPLE 5, except that ammonia gas was blew onto the molten copper surface at 10 L/minute (or 0.010 L/minute per unit area ($cm^2$) of the copper). The resulting fine particles had a diameter of 0.1 to 0.5 μm and BET diameter of 3.5 μm. The crystallites were 0.1 to 5 μm in size. The fine powder product contained oxygen at 0.20% by weight.

The powder production rate was 0.8 g/second·$m^2$, determined from quantity of the metallic copper left in the crucible, and 0.5 g/second·$m^2$, determined from quantity of the recovered fine powder of the metallic copper. Therefore, it was much lower than those observed in EXAMPLES 5 to 7.

Comparative Example 3

The fine powder of metallic copper was prepared in the same manner as in EXAMPLE 5, except that ammonia gas was blew onto the molten copper surface at 15 L/minute (or 0.012 L/minute per unit area ($cm^2$) of the copper). The resulting fine particles had a diameter of 0.1 to 5 μm and BET diameter of 3.2 μm. The crystallites were 0.1 to 5 μm in size. The fine powder product contained oxygen at 0.3% by weight.

The powder production rate was 1.0 g/second·$m^2$, determined from quantity of the metallic copper left in the crucible, and 0.8 g/second·$m^2$, determined from quantity of the recovered fine powder of the metallic copper. Therefore, it was much lower than those observed in EXAMPLES 5 to 7.

As discussed above, the fine powder of metallic copper of the present invention is composed of the particles of high sphericity, having a BET diameter of 3 μm or less, large crystallite size and high dispersibility. It satisfies all of the characteristics now required for an electroconductive metallic powder for electroconductive pastes for forming circuits or multilayer capacitors, and hence is very useful as a material for electroconductive pastes.

One of the preferred embodiments of the present invention is the electroconductive metallic powder containing oxygen at 0.3% by weight or less, a characteristic which makes the powder suitable for some devices, e.g., multilayer capacitors, which are very sensitive to oxide formed therein.

Moreover, the process of the present invention for producing the fine powder of metallic copper, blowing an ammonia-containing gas onto molten copper kept at 1120° C. or higher, is of high industrial value, because it is highly reliable and practical, and can highly efficiently produce the particles of excellent characteristics and hence of high industrial value. Its usefulness should be further enhanced, when ammonia gas is blew at 0.015 L/minute or more per unit area ($cm^2$) of the molten copper, because the fine powder of metallic copper of the present invention can be produced stably and efficiently under the above condition.

What is claimed is:

1. A process for producing the fine powder of metallic copper having a BET diameter of 3 μm or less comprising blowing an ammonia-containing gas onto molten copper, wherein the molten copper is kept at 1120° C. or higher, and wherein said ammonia-containing gas is blown at 0.015 L/minute or more per unit area ($cm^2$) of said molten copper.

2. The process according to claim 1 for producing the fine powder of metallic copper, wherein said ammonia-containing gas is ammonia gas itself, or a mixture of ammonia gas and a non-oxidative or inert gas.

* * * * *